United States Patent [19]

Camp et al.

[11] Patent Number: 4,476,099

[45] Date of Patent: Oct. 9, 1984

[54] METHOD OF RECOVERING URANIUM

[75] Inventors: Floyd E. Camp, Trafford, Pa.; Amy B. Swartzlander, Arvada, Colo.

[73] Assignee: Wyoming Mineral Corporation, Lakewood, Colo.

[21] Appl. No.: 219,715

[22] Filed: Dec. 24, 1980

[51] Int. Cl.[3] ..... C01G 43/00

[52] U.S. Cl. ..... 423/10; 423/15; 423/17; 423/253

[58] Field of Search ..... 423/10, 15, 17, 253

[56] References Cited

U.S. PATENT DOCUMENTS

| | | | |
|---|---|---|---|
| 2,780,519 | 2/1957 | Kaufman | 423/253 |
| 2,797,143 | 6/1957 | Arendale | 423/253 |

FOREIGN PATENT DOCUMENTS

| | | | |
|---|---|---|---|
| 768946 | 2/1957 | United Kingdom | 423/15 |
| 473675 | 10/1973 | U.S.S.R. | 423/253 |

OTHER PUBLICATIONS

Mellor, *A Comprehensive Treatise on Inorganic and Theoretical Chemistry,* vol. XII, Longmans Green & Co., (1932), pp. 128–138.

Klygin et al., in *Chemical Abstracts,* vol. 56, (1961), #1996h.

*Primary Examiner*—John Doll
*Assistant Examiner*—Robert L. Stoll
*Attorney, Agent, or Firm*—R. D. Fuerle

[57] ABSTRACT

Uranium is recovered from a carbonate leach solution containing a dissolved uranium salt and a monovalent ion. The pH of the leach solution is adjusted to about 5 to about 7.5, and preferably to about 6 to about 7. Phosphate ion is then added to typical in-situ leach solutions in an amount from about 10 to about 30 mole % in excess of the amount needed to stoichiometrically react with the uranium in said solution. This results in the precipitation of a compound made up of the monovalent ion, uranium, and the phosphate ion, which is insoluble in the solution. The precipitate is then separated from the solution preferably by means of a centrifuge or a vortex clarifier. It can then be dissolved in acid, and the uranium extracted into an organic solvent such as DEHPA-TOPA in kerosene.

13 Claims, 1 Drawing Figure

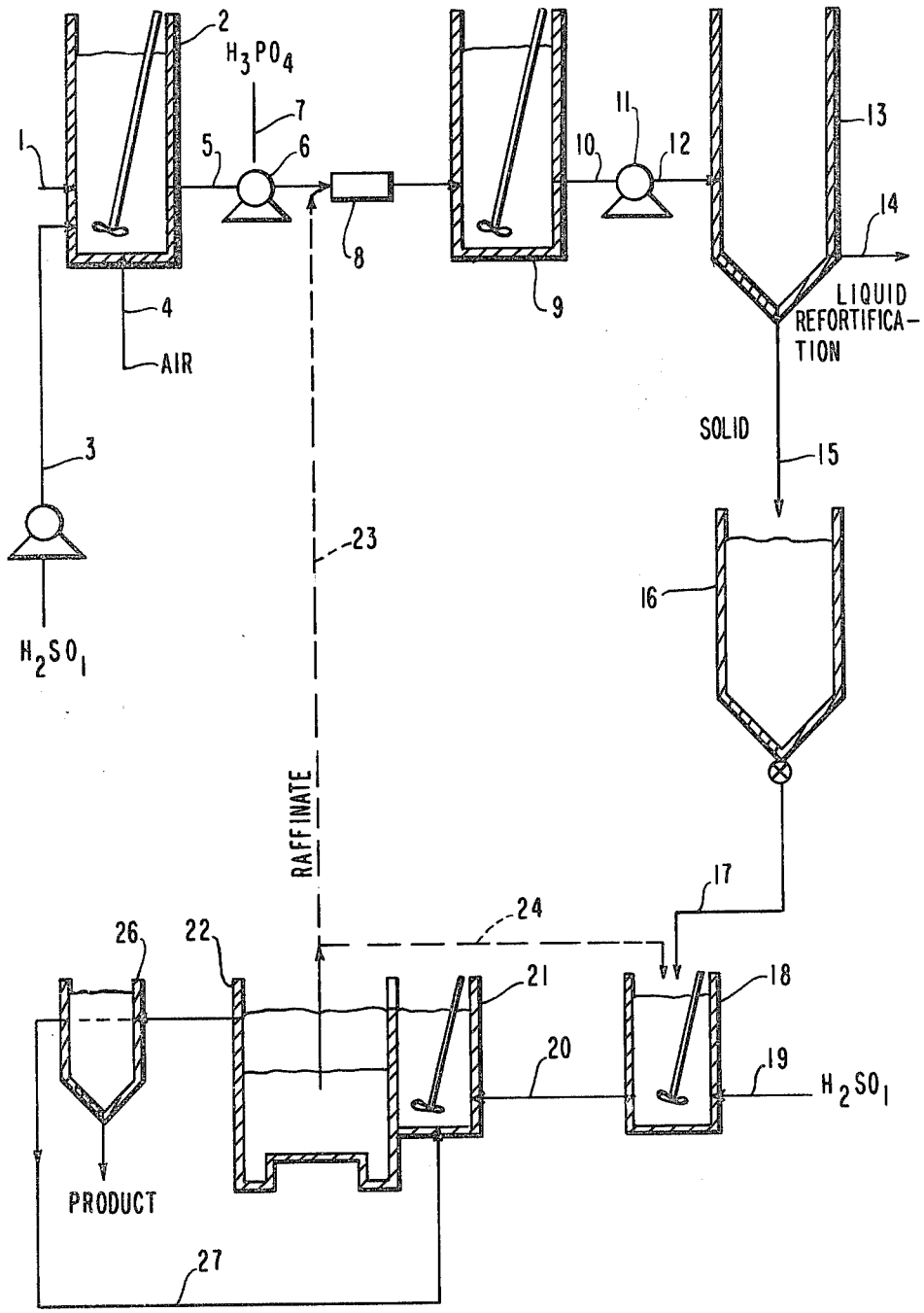
2
$H_3PO_4$
7
1
5
6
8
9
10
11
12
13
14
4
AIR
LIQUID
REFORTIFICA-
TION
SOLID
15
3
23
16
$H_2SO_1$
RAFFINATE
17
24
26
22
21
18
20
19
$H_2SO_1$
PRODUCT
27

METHOD OF RECOVERING URANIUM

BACKGROUND OF THE INVENTION

Solution mining or the in-situ leaching of uranium is a relatively recent development which allows economical uranium recovery from lower grade ores which are otherwise (by traditional mining, crushing, beneficiation, etc.) too expensive to process. A solution containing $(NH_4)_2CO_3$ and an oxidant ($H_2O_2$ or dissolved $O_2$) is pumped into an ore body where the uranium is oxidized to the soluble +6 oxidation state, causing it to enter the leaching solution. The solution is then pumped out of the ore body and is processed to recover the uranium contained in it. The uranium is usually recovered by passing the solution over an ion-exchange resin to which the uranyl carbonate complex attaches. It can then be eluted off the column and precipitated as ammonium diuranate.

SUMMARY OF THE INVENTION

We have discovered a method of recovering the uranium from a carbonate leach solution which avoids the use of ion exchange columns. In our invention the pH of the solution is adjusted and phosphate ion is added which results in the precipitation of an insoluble uranyl phosphate compound.

Unlike the ion exchange columns, which recover molybdenum and vanadium which must also later be separated from the uranium, in the process of this invention only the uranium is precipitated and the molybdenum and vanadium remain in solution. While the ion exchange method recovers only about 70 to 90% of the uranium in the leach solution, the process of this invention recovers about 98 to over 99% of uranium in solution. The capital and operating expenses of the method of this invention are less than the ion exchange process and less space is required for the equipment.

PRIOR ART

The properties of ammonium and sodium uranyl phosphate are disclosed by J. W. Mellor in "A Comprehensive Treatise on Inorganic and Theoretical Chemistry," Volume XII, published by Longman, Green, and Co., 1932, pp. 128 to 138. U.S. Pat. No. 2,780,519 discloses the precipitation of a uranous phosphate as a means of recovering uranium.

DESCRIPTION OF THE INVENTION

The accompanying drawing is a diagram illustrating a certain presently preferred embodiment of the process of this invention. In the drawing, a carbonate leaching solution in line 1 enters mix tank 2 where it is mixed with sulfuric acid from line 3 and is sparged with air from line 4 to remove carbon dioxide. The sulfuric acid and air sparge adjust the pH of the leach solution to within the range required for precipitation of the insoluble uranium salt. The solution then proceeds through line 5 to pump 6 where a phosphate such as phosphoric acid is added from line 7. The solution is mixed in static mixer 8 and in mixing tank 9 to ensure a complete reaction and the precipitation of the insoluble uranium compound. The solution then proceeds through line 10 to pump 11 and line 12 into vortex clarifier 13 which separates the precipitate from the remaining mother liquor. The mother liquor then proceeds through line 14 where it can be refortified with carbonate and pumped back into the ground again for additional leaching. The solids pass through line 15 into slurry storage tank 16. As needed, they are passed through line 17 to mix tank 18 where they are dissolved with sulfuric acid from line 19. The dissolved precipitate passes through line 20 into mix tank 21 then into extractor 22 where the uranium is extracted into an organic liquid phase. The raffinate can then be sent by line 23 back into static mixer 8 or through line 24 to dissolve the precipitate in mix tank 18. The organic phase containing the extracted uranium passes from extractor 20 through line 25 into precipitation tank 26 where the uranium is precipitated by conventional and well known processes. The organic phase containing the extractant is then recycled through line 27 into mix tank 21.

The initial solution containing the uranium may be of almost any composition as long as a monovalent ion such as sodium or ammonium is present to form the precipitate uranium compound. If such a monovalent ion is not present it may be added in a quantity sufficient to form the precipitate. Typically, the initial leach solution will be a carbonate leach solution such as sodium or ammonium carbonate which generally contains 0.1 to about 1.0% sodium or ammonium carbonate. The solution would also typically contain 80 to about 200 parts per million (ppm) of uranium in the form of a uranyl carbonate complex. However, solutions containing as little as 10 ppm can still be treated. Uranium containing solutions such as uranyl nitrate solutions may also be treated by the process of this invention.

The first step in the process of this invention involves adjusting the pH of the initial solution to between about 5 and about 7.5. If the pH is less than 5, the uranium precipitate starts to become soluble and the process becomes less economical. If the pH is greater than 7.5, no precipitate forms. The preferred pH range is about 6 to about 7 as that range results in the greatest amount of precipitate and the lowest chemical cost. Since a typical lixiviant has a pH of about 8 to about 9 it will be necessary to lower the pH of the initial solution. The pH may be lowered by adding any mineral acid such as hydrochloric, sulfuric, phosphoric, or nitric acid. Sulfuric acid is preferred as it is the least expensive. The pH of a carbonate leach solution can also be lowered by blowing air through the solution which removes carbon dioxide, as illustrated by the equation $CO_2+H_2O \rightleftarrows H_2CO_3 \rightleftarrows H_3O+HCO_3^-$. However, if the initial solution is acidic it will be necessary to raise the pH to the proper range, which can be accomplished by adding an alkali metal or ammonium hydroxide.

The next step of the invention, which is the addition of phosphate ion, may be performed before or after the pH adjustment. It is preferable to perform this step after the pH adjustment because that way it is easier to control the pH since the pH tends to rise as the uranium precipitates. Any source of phosphate ion may be used such as an alkali metal or ammonium phosphate, but phosphoric acid is preferred because it is cheaper and does not introduce additional cations. The amount of phosphate ion added depends on how much uranium is in the solution so that it is necessary to measure the uranium content of the solution, which can be done by well-known laboratory analyses. The amount of phosphate ion added should be about 10 to about 30% in excess of the amount stoichiometrically required to form the uranium precipitate. If less than about 10% in excess is used, some of the uranium may not be precipitated and if more than 30% excess is used it adds to the expense of the process, it is unnecessary, and it leaves phosphate ion in the leach solution which may precipitate uranium under the ground if the leach solution is reused. However, if the uranium solution contains less than about 80 ppm uranium, it will be necessary to use more than 30% excess phosphate ion.

Once the pH has been adjusted and a phosphate ion has been added, a very fine precipitate will form which is a compound of the uranium, the phosphate ion, and whatever monovalent ion is present. The most probable formula for this precipitate is $MUO_2PO_4.3H_2O$ where M is the monovalent ion, typically sodium or ammonium. Other possible formulas for the precipitate include $H_2(UO_2)_2(PO_4).8H_2O$ where one or two $NH_4$ groups may be substituted for one or both of the hydrogens, or $2UO_3.P_2O_5.9H_2O$, or $U_2O_3P_2O_7$. We do not wish to be bound by any particular theory as to the formula for this precipitate.

In the next step of the process of this invention it is necessary to separate the precipitate from the liquid. This may be done by any means found advantageous, but since the precipitate is extremely fine, it is preferable to separate it with a clarifier such as a vortex clarifier or a centrifuge. The mother liquid may be refortified with additional carbonate and put back underground.

The precipitate may then be dissolved in a strong mineral acid such as phosphoric, hydrochloric, or nitric, but preferably sulfuric acid is used as it is inexpensive. Only a sufficient amount of acid is used to dissolve the precipitate. The uranium may be extracted from this acidic solution using any of the well known uranium extractants such as di-2-ethylhexylphosphoric acid-trioctylphosphine oxide (DEHPA-TOPA) in an organic solvent such as kerosene. Typically, the DEHPA-TOPA concentration is about 0.1 to about 1 molar and the volume ratio of the organic to the aqueous phase is about 0.5 to 1 to about 1.5 to 1.

The raffinate, which is very acidic, can be used to dissolve additional precipitate or to adjust the pH of the initial leach solution, or it can be treated as waste. The following examples further illustrate this invention.

EXAMPLE

Simulated ammonium carbonate solution mining liquids were prepared having the following ionic composition (ppm): $1785CO_3^{-2}$, $1790SO_4^{-2}$, $1750NH_4^{+1}$, $1560Cl^{-1}$, $183Ca^{+2}$, $50Mo^{+6}$, $40Mg^{+2}$, $721Na^{+1}$ and $30K^{+1}$. To 300 ml. of above solution containing 22.4 ppm $U_3O_8$and having a pH of 8.18, 0.75 ml. 30% $P_2O_5$ phosphoric acid was added bringing the pH down to 7.3 and forming a cloudy solution which was filtered through a 0.45$\mu$ pore size filter. The mother liquor was then analyzed to contain 0.85 ppm $U_3O_8$. In another test, 1 liter of solution containing 101.6 ppm $U_3O_8$ and having a pH of 8.24 was used. Four ml. of 30% $P_2O_5$ phosphoric acid brought the pH down to 6.4 and the mother liquor contained less than 1.06 ppm $U_3O_8$.

In another test, molybdenum analyses were run on the solution before and after precipitation, showing both contained 50 ppm $Mo^{+6}$. In this test, 3 liters of solution containing 118.2 ppm $U_3O_8$ had 15 ml 30% $P_2O_5$ phosphoric acid added bringing pH down to 6.6. The mother liquor contained 0.85 ppm $U_3O_8$. The filter cake from this test was analyzed to contain 69.4 wt.% $U_3O_8$.

A much higher $U_3O_8$ content was then tried (1016.5 ppm). The additional uranium content apparently acted as a pH buffer since caustic (NaOH) was required to keep pH between 6 and 7 after the addition of 30 ml. 30% $P_2O_5$ phosphoric acid to three liters of ammonium carbonate solution. The mother liquor then contained 1.06 ppm $U_3O_8$.

In this and following tests a less expensive acid such as HCl or $H_2SO_4$ was used initially to lower pH. To one liter of $(NH_4)_2CO_3$ solution containing 101.6 ppm $U_3O_8$ and having pH of 8.2 was added 10 ml. of 1M HCL, lowering the pH to 7.3. Two ml of 30% $P_2O_5$ phosphoric acid was then added to bring the pH down to 6.7 and precipitate. the $(NH_4)(UO_2)(PO_4).3H_2O$. The mother liquor contained 0.88 ppm $U_3O_8$.

One liter of $(NH_4)_2CO_3$ solution containing 101.6 ppm $U_3O_8$ had its pH lowered from 8.56 to 7.09 with 27.5 ml. of 0.5M $H_2SO_4$. The subsequent addition of 0.75 ml. 30% $P_2O_5$ phosphoric acid dropped the pH to 6.6 causing the precipitation. The mother liquor contained 1.83 ppm $U_3O_8$.

Some larger quantities of ammonium carbonate solution containing a nominal 100 ppm $U_3O_8$ were precipitated for the purpose of performing settling tests according to a procedure set forth by a vendor of vortex clarifiers. The greater amounts of precipitate produced allowed more complex analyses of the air-dried material to be made as follows:

| $U_3O_8$ | $PO_4^{-3}$ | $NH_4^{+1}$ |
|---|---|---|
| 69.4 wt. % | 24.2 wt. % | 4.37 wt. % |
| 66.5 wt. % | | 4.45 wt. % |
| 69.0 wt. % | | |

The air-dried precipitate also showed a 24.6% weight loss at red heat. A thermogravimetric analysis (TGA) showed that 8.5% free $H_2O$ is given off between 20° C. and 110° C., 8.0% hydrated $H_2O$ liberated between 100° C. and 450° C., and that 3.5% $NH_3$ is evolved between 450° C. and 550° C.

To show that a uranyl phosphate may also be precipitated from ammonium-free solutions such as sodium carbonate lixiviant, the following tests were made with solutions containing 1585 ppm $CO_3^{-2}$, 2897 ppm $Na^{+1}$, 1542 ppm $Cl^{-1}$, 1623 ppm $SO_4^{-2}$, 40 ppm $Mg^{+1}$, and 31 ppm $K^{+1}$. A one liter batch containing 92.2 ppm $U_3O_8$ with a pH of 11.1 was precipitated using 4 ml. 30% $P_2O_5$ phosphoric acid, which lowered the pH to 6.86, leaving a mother liquor which contained 1.18 ppm $U_3O_8$. Another one liter batch containing 92.2 ppm $U_3O_8$ had the pH lowered to 6.98 with 2.3 ml. concentrated HCl then 5 ml. of phosphoric acid having a concentration of 0.00681 g. $PO_4$/ml. was added. No cloudiness appeared until the pH was further lowered to 6.52 by dropwise HCl addition. The mother liquor contained 4.9 ppm $U_3O_8$ and this $PO_4$ dosage represents 1.04 times the stoichiometric requirement. As determined by emission spectroscopy, the precipitate in these cases was a sodium analog of the ammonium uranyl phosphate or $Na(UO_2)(PO_4).3H_2O$.

Various approaches to make a $P_2O_5$-$U_3O_8$ separation in an acidic solution of the ammonium uranyl phosphate were tried and solvent extraction with DEHPA-TOPO proved to be the best. The acidic solution was prepared by adding 7 ml. of concentrated $H_2SO_4$ to 200 ml. of settled $(NH_4)(UO_2)(PO_4).3H_2O$ slurry. $U_3O_8$ and $PO_4^{-3}$ analyses on the solution were 8274 and 1060 ppm respectively. Equal volumes (20 ml.) of it and 0.5M DEPHA-0.125M TOPO in Amsco 450 kerosene were mixed for 10 minutes (3 to 5 minutes is probably adequate). Phase coalescence was complete within one minute. The following analyses show the resulting $P_2O_5$-$U_3O_8$ separation:

| | Before Shakeout | | After Shakeout | |
|---|---|---|---|---|
| | $PO_4^{-3}$ ppm | $U_3O_8$ (ppm) | $PO_4^{-3}$ (ppm) | $U_3O_8$ (ppm) |
| Aqueous | 1060 | 8274 | 970 | 3.3 |
| Organic | 0 | 0 | — | 7979 |

Present technology may then be relied upon to strip the $U_3O_8$ loaded organic with $Na_2CO_3$ or $(NH_4)_2CO_3$, depending on whether AUT (ammonium uranyl tricarbonate) or ADU (ammonium diuranate) is the desired end product.

What we claim is:

1. A method of recovering uranium from a carbonate leach solution containing a uranyl carbonate complex and a monovalent ion comprising:
   (1) adjusting the pH of said solution to about 5 to about 7.5;
   (2) adding phosphate ion to said solution in an amount at least about 10 mole % in excess of the amount needed to react stoichiometrically with said uranium to form a compound of said monovalent ion, uranium, and said phosphate which is insoluble in said solution; and
   (3) separating said insoluble compound from said solution.

2. A method according to claim 1 wherein said solution is an ammonium carbonate leach solution containing about 80 to about 200 ppm of uranium as said uranyl carbonate complex.

3. A method according to claim 2 wherein the amount of phosphate ion does not exceed about 30 mole % in excess of the amount needed to react stoichiometrically with said uranium.

4. A method according to claim 2 wherein said pH is adjusted by blowing air through said solution to remove carbon dioxide.

5. A method according to claim 1 wherein said pH is adjusted with $H_2SO_4$.

6. A method according to claim 1 wherein said pH is adjusted to about 6 to about 7.

7. A method according to claim 1 wherein said phosphate is added before said pH is adjusted.

8. A method according to claim 1 wherein said insoluble compound is $MUO_2PO_4.3H_2O$ where M is selected from the group consisting of alkali metals, ammonium, and mixtures thereof.

9. A method according to claim 1 wherein said insoluble compound is separated from said solution with a centrifuge or vortex clarifier.

10. A method according to claim 1 including the additional last step of dissolving said insoluble compound in a strong mineral acid.

11. A method according to claim 10 wherein said strong mineral acid is sulfuric acid.

12. A method according to claim 10 wherein including the additional last step of extracting uranium from said solution of said insoluble compound in said strong acid.

13. A method according to claim 12 wherein said uranium is extracted using di-2-ethylhexyl phosphoric acid-trioctyl phosphine oxide in an organic solvent.

* * * * *